United States Patent [19]

Randmae

[11] Patent Number: 4,991,363

[45] Date of Patent: Feb. 12, 1991

[54] PORTABLE PROTECTIVE ENCLOSURE FOR A VEHICLE

[76] Inventor: Rein Randmae, 12 Breezy Hill Dr., Northport, N.Y. 11768

[21] Appl. No.: 404,258

[22] Filed: Sep. 7, 1989

[51] Int. Cl.[5] ..... E04B 1/34

[52] U.S. Cl. ..... 52/2 R; 135/88

[58] Field of Search ..... 52/2 R, 28, 29, DIG. 19, 52/2 N

[56] References Cited

U.S. PATENT DOCUMENTS

| | | | |
|---|---|---|---|
| 2,311,514 | 2/1943 | Bramblett . | |
| 2,366,600 | 1/1945 | Daniel . | |
| 2,480,509 | 8/1949 | Ripley . | |
| 2,598,940 | 6/1952 | Robie . | |
| 2,733,747 | 2/1956 | Altschul . | |
| 2,798,501 | 7/1957 | Oliver | 135/88 X |
| 2,989,967 | 6/1961 | Lee . | |
| 3,036,583 | 5/1962 | Miller . | |
| 3,042,051 | 7/1962 | Mauldin . | |
| 3,335,529 | 8/1967 | Gedney . | |
| 3,463,174 | 8/1969 | Heller . | |
| 3,496,686 | 2/1970 | Bird . | |
| 3,929,118 | 12/1975 | Hickey | 32/2 N X |
| 3,940,099 | 2/1976 | McCleskeg | 135/88 X |
| 4,140,191 | 2/1979 | Hickey . | |
| 4,154,254 | 5/1979 | Spencer . | |
| 4,294,483 | 10/1981 | Ferris . | |
| 4,567,696 | 2/1986 | Malet . | |
| 4,605,030 | 8/1986 | Johnson . | |

OTHER PUBLICATIONS

"Carbana", Brochure, folds out to $8\frac{1}{2} \times 11''$.

"Omni Bag", Brochure, folds out to $8\frac{1}{2} \times 11''$.

*Primary Examiner*—Richard E. Chilcot, Jr.

*Assistant Examiner*—Creighton Smith

*Attorney, Agent, or Firm*—Nolte, Nolte & Hunter

[57] ABSTRACT

An air-supported enclosure for the protection of a vehicle from the harmful effects of the outdoor environment comprising a flexible sheeting totally surrounding but not touching the vehicle. Access into the enclosure is gained by a slide fastener which extends around three sides of the enclosure. The enclosure is ventilated to minimize temperature differentials between its interior and its exterior therefore also minimizing the formation of condensation in its interior.

24 Claims, 4 Drawing Sheets

PORTABLE PROTECTIVE ENCLOSURE FOR A VEHICLE

BACKGROUND OF THE INVENTION

The invention relates to means of enclosing a vehicle, such as an automobile, truck or the like, for the purpose of protecting it from the destructive elements of the environment, for example, moisture, acid rain, sunlight, dust and dirt.

The need for an enclosure such as claimed in this invention arises from the recent popularity and growth of the collector car market. There is an increasing need to shelter such collector cars, especially outdoors, since indoors garage space is becoming increasingly scarce and expensive to obtain. Numerous shelters and protective devices are presently used for protection of vehicles, including car covers, car tents, protective bags and enclosed trailers or buildings. A few types of car covers can acceptably protect the upper part of an automobile from rain and sunlight but they offer very limited protection for the lower parts of a vehicle, namely the wheels, chassis parts, rocker panels and bumpers, from splashing water, blowing snow and rising moisture from the ground. Further, a car cover will physically contact the painted surfaces of a vehicle, casing possible damage from abrasion. A car tent such as cited in J. F. Oliver, Collapsible Housing Structure, U.S. Pat. No. 2,798,501 (1957), can also protect an automobile from rain and sunlight but being of an open construction at the bottom, it cannot protect from rising ground moisture. Also, since a car tent is normally not ventilated, it has a tendency under certain temperature conditions to accumulate condensation on its inside walls which can cause water droplets to form and drip on the vehicle. The resulting high humidity conditions can cause severe corrosion damage to steel and chrome plated parts. Enclosed bags of flexible material are also known to exist for the storage of automobiles. Such bags are only intended for indoor use and are inconvenient to use since they are openable only from one end. Enclosed trailers or garages are generally relatively very expensive compared to this invention and are not easily disassembled, moved or transported. Although air supported structures have been heretofore utilized for the containment of vehicles; such structures have not been as ideally suited for the task of protection and preservation of vehicles as the protective enclosure claimed herein. Prior air supported structures have employed extensive means to anchor the perimeter of the structure to the ground or to a pre-fabricated base. Such anchors must necessarily bear heavy tension loads developed by upward air pressure on the roof of the structure and must therefore be of heavy construction and costly. Examples of such construction are shown in Malet, Inflatable Structure For Use As A Shelter, U.S. Pat. No. 4,567,696 (1986), FIGS. 4 and 5 and in W. W. Bird, Weather-Tight Enclosure System, U.S. Pat. No. 3,496,686 (1970) FIG. 5. In addition, methods must be employed to seal the perimeter of such air supported structures either to a special base member or to an underlying surface, increasing cost of manufacture further. This type of construction is shown in Hickey, U.S. Pat. No. 3,929,178 (1975) as well as Patents of Malet and W. W. Bird referenced above, wherein the perimeter of a cover part is being sealed to a base member. In contrast, the portable protective enclosure claimed herein does not require means for sealing nor anchoring its perimeter. Further, Hickey's Patent referenced above would not be as suitable as this invention for housing vehicles with fine paint finishes, since its flexible cover interior is not pressurized, and thus self supporting, but opposingly is drawn tightly in contact with the vehicle by means of suction applied to its interior, thereby possibly causing damage to the paint finish of the vehicle.

OBJECTS OF THE INVENTION

It is an object of this invention to overcome the disadvantages cited above and provide a protective enclosure for a vehicle which totally encloses the vehicle including the bottom surface to prevent evaporating moisture from the ground from causing corrosion damage to parts of the vehicle such as bare steel chassis parts and chrome plated parts.

It is a further object of this invention to provide a protective enclosure for a vehicle which is ventilated for nearly equalizing the temperature inside the enclosure compared with the temperature outside the enclosure, therefore minimizing condensation formation on the vehicle.

It is another object of this invention to provide a protective enclosure for a vehicle which eliminates, in an air supported structure, the need for expensive sealing methods between a base members and an upper cover member by providing a shell that continuously encircles the vehicle, including the bottom.

It is a further another object of this invention to provide a protective enclosure for a vehicle which under normal conditions remains free of the vehicle, preventing damage to painted surfaces of the vehicle from abrasion.

It is another object of this invention to provide a protective enclosure for a vehicle which is convenient to use and which allows rapid entry and exit along with the ability to store or transport the enclosure in a small space.

It is yet another object of this invention to provide a protective enclosure for a vehicle which, when in use is firmly held in place due to the weight of the vehicle resting upon it and therefore, does not need extensive anchoring techniques to attach it to the ground and is resistant to wind and other forces attempting to move it.

Further objects and advantages of the invention will become apparent from the following summary, specifications and drawings.

SUMMARY OF THE INVENTION

In accordance with the invention, an air supported enclosure is provided, fabricated of lightweight vinyl sheeting, which when inflated encloses a vehicle on all sides including the bottom. A slide fastener in the form of a zipper is provided on three sides of the enclosure for access to its interior. The zipper closure is protected from entry of moisture by an overflap of the vinyl material covering the fastener.

Located in the interior of the front part of the enclosure is a fan which functions to inflate and pressurize the enclosure. The pressure differential thus developed is sufficient to support the enclosure and stabilize it so that it remains unaffected by strong wind velocities. The fan also functions to ventilate the enclosure so the temperature within the enclosure remains nearly equal to the temperature outside the enclosure. The air inlet port of the fan is connected through an opening in the vinyl sheeting to an S shaped duct which at the other end connects to a filter housing containing a washable filter element to filter fine dust particles from the incoming air stream and a coarse screen to exclude larger dirt particles, falling leaves, bugs, snowflakes and the like. Due to the configuration of the S shaped duct, the filter housing is located in a relatvely high position and in an inverted manner to place the open end of the housing facing down. This prevents entry of water and keeps the air intake port free of snow accumulations.

A supporting frame, fabricated preferentially of round steel tubing, rests on the vinyl sheeting at the bottom surface of the enclosure and encircles the vehicle. Supports, made of sheet metal rest loosely on the supporting frame and extend under at least four wheels of the enclosed vehicle, placing the full weight of the vehicle on the supporting frame. This holds the bottom of the enclosure firmly on the ground and directs the vinyl sheeting away from the vehicle. The frame is fabricated in sections attached by connectors which enable it to be disassembled and transported or stored conveniently. The vinyl sheeting can be folded around the fan assembly to create a small transportable package.

Although one particular embodiment of this invention is shown, it is understood that many different sizes, shapes and configurations of the invention may be fabricated within the scope of the claim set forth.

DESCRIPTION OF THE PREFERRED EMBODIMENT

Figure 1:
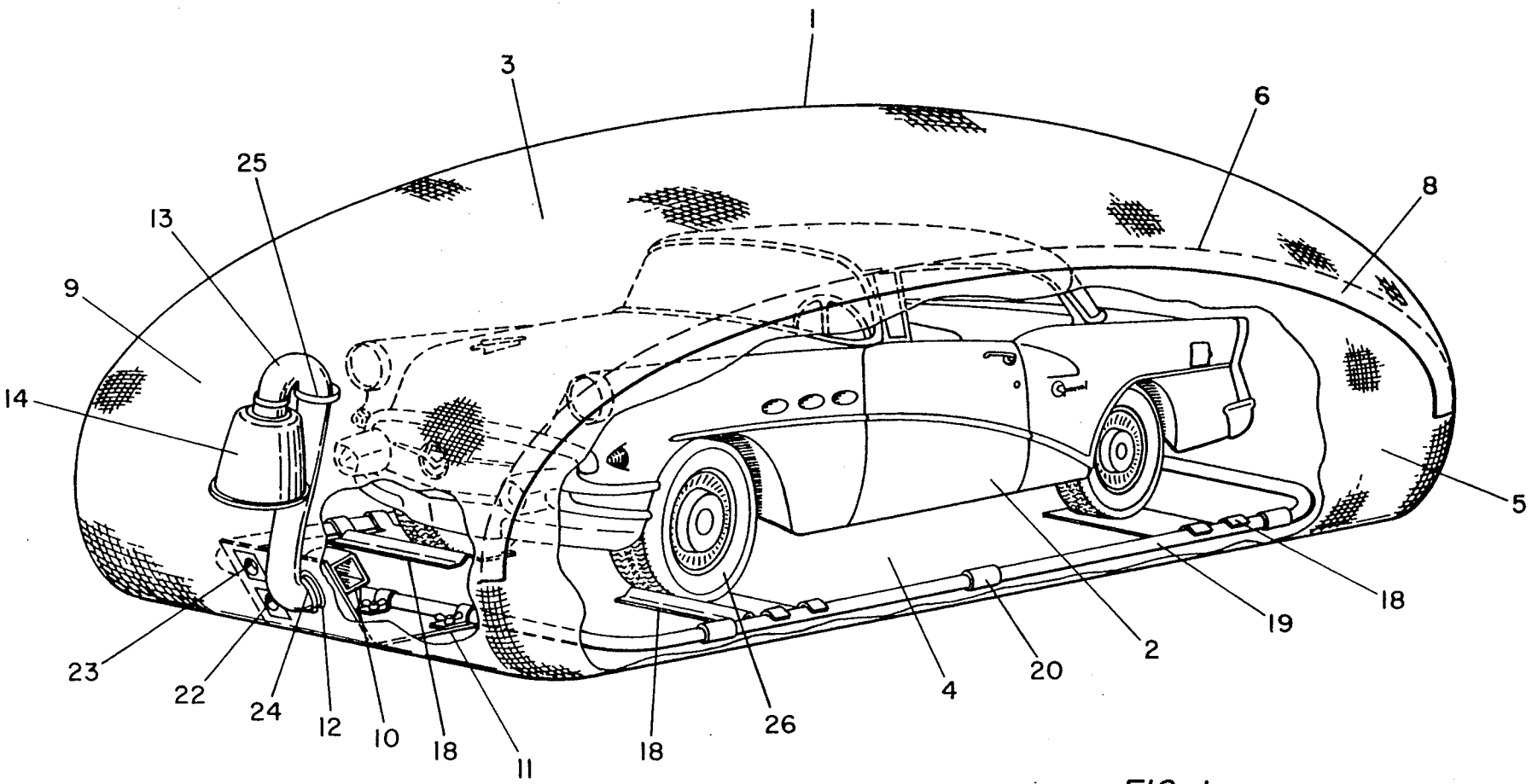
FIG. 1 is a left front partial cut-away view of the inflated enclosure also showing the filter housing and duct.
Figure 3:
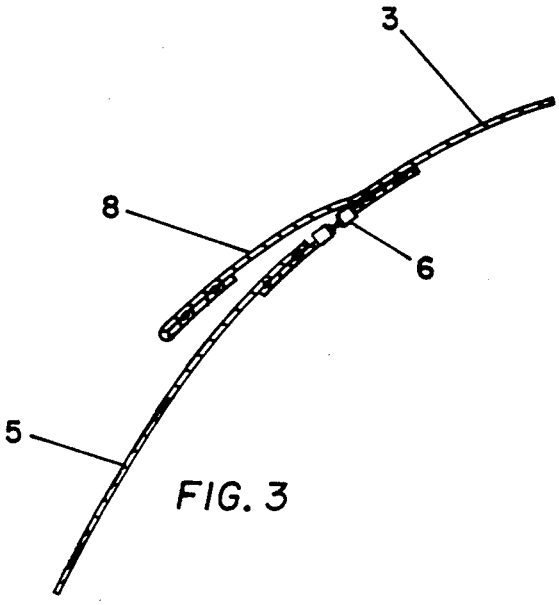
FIG. 3 is a detail sectional view of the zipper closure and weather protective overflap taken along lines 3—3 of FIG. 2.

With reference to the figures, in FIG. 1 a flexible sheeting 1 preferably made of lightweight, watertight, reinforced vinyl material, encloses totally within it a vehicle 2, such as an automobile. The sheeting 1 comprises a rectangular top portion 3, a rectangular bottom portion 4 and essentially bread-loaf shaped sides 5 joined by sewing or electronic welding technique to form a completely watertight enclosure surrounding the vehicle on all sides, including bottom.

A closure means, preferably a heavy duty zipper 6 extending on two sides 5 and rear 7 allows when opened access to the interior of the enclosure. An overlapping strip of sheeting material 8 covers the zipper 6 so that water entry is not possible.

Figure 6:
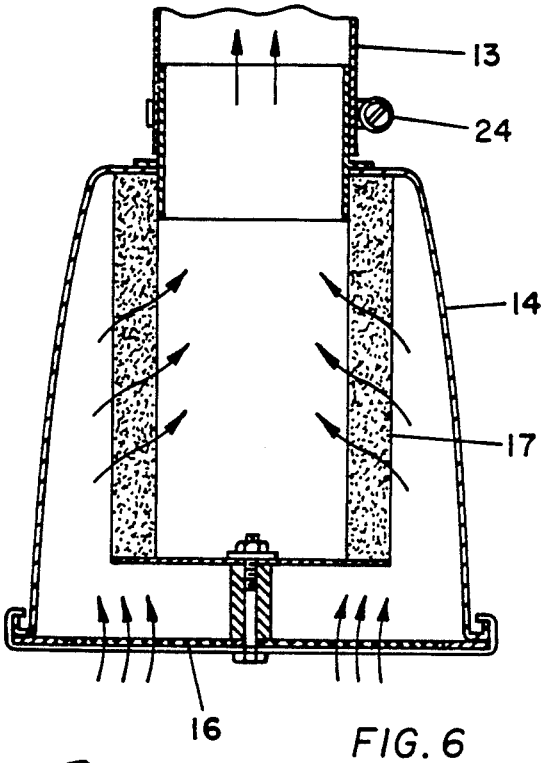
FIG. 6 shows a cross sectional view of the filter housing.
Figure 2:
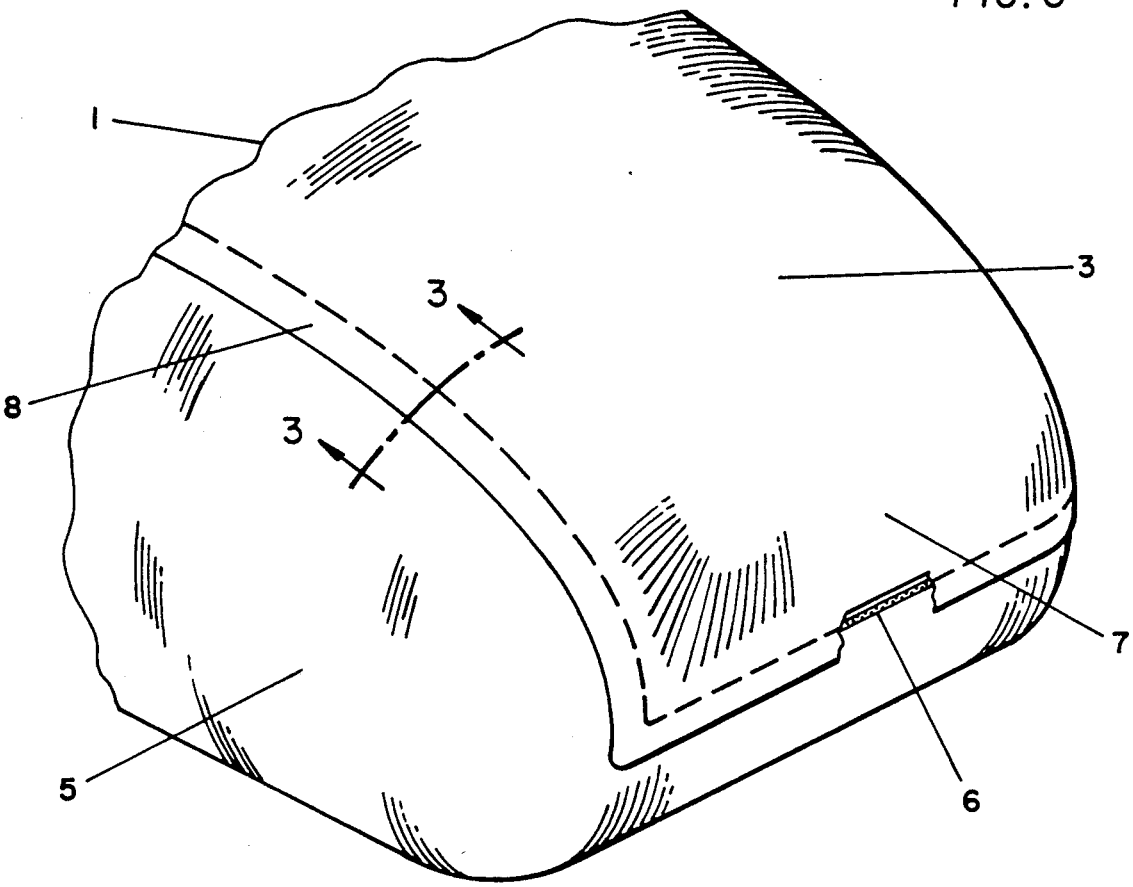
FIG. 2 is a left rear view of the inflated enclosure showing the zipper closure and overflap.
Figure 7:
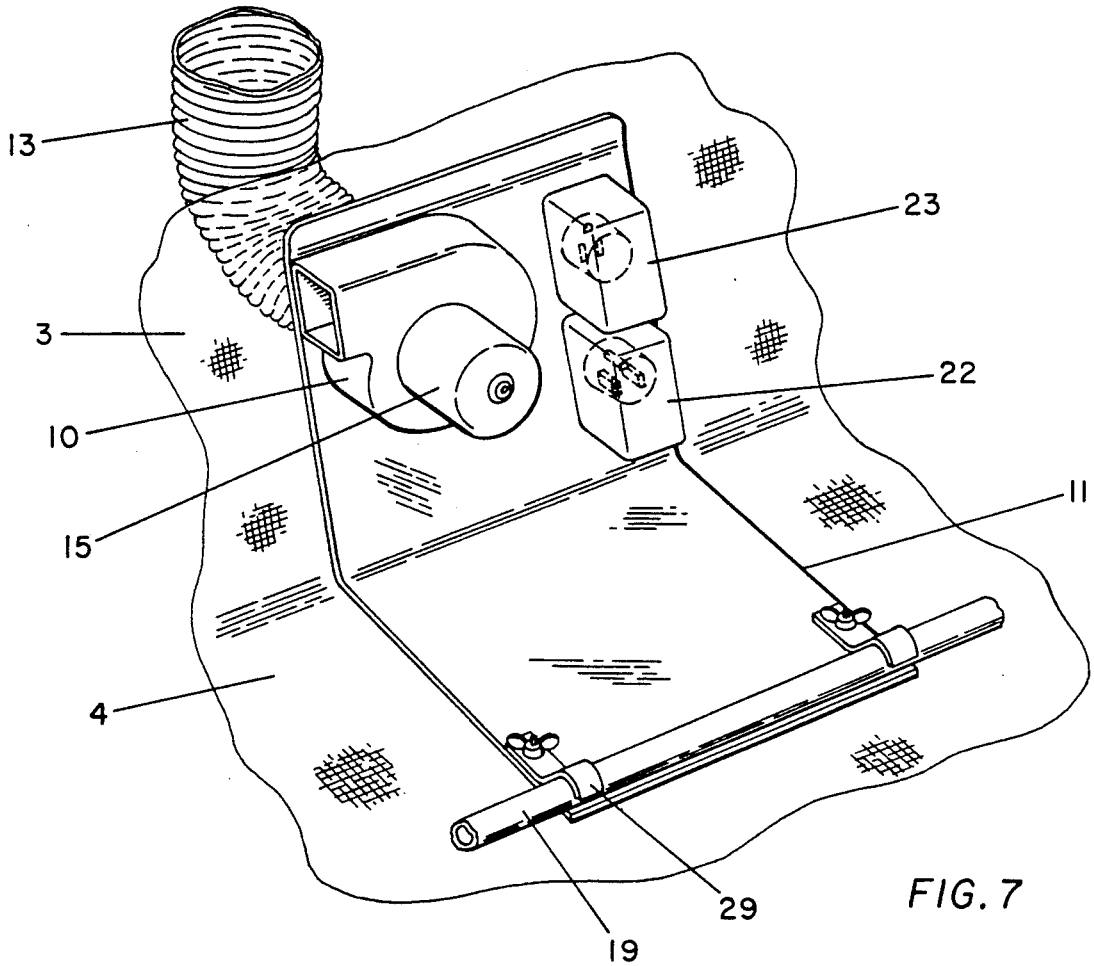
FIG. 7 is a view from the interior of the enclosure showing the ventilator fan and duct.

Located within the front part of the enclosure 9 a ventilating fan 10 is mounted on a bracket 11 and situated so that its air intake port faces an opening in the enclosure sheeting having a fitting 12 connecting to a flexible ducting 13 leading to a filter housing 14. Referring to FIGS. 6 and 7, when the motor 15 driving the impeller of ventilating fan 10 is electrically energized, air is drawn in through a screen 16, enters the filter housing 14, flows through filter 17, duct 13, and is discharged by the fan 10 into the interior of the enclosure causing it to become inflated. Once inflated and an equilibrium condition is attained, the airflow is of such magnitude that it equals the leakage through small openings in the enclosure and through the zipper 6 which is designed to leak an amount of air sufficient to ventilate the enclosure. The fan 10 is sized to develop pressure against this fixed airflow to keep the enclosure firmly inflated. In this equilibrium condition the flexible sheeting 1 assumes a semicircular shape in cross section. The fan 10 is mounted on the bracket 11 whose lower edge is attached to frame 19 by clamps 20. Clamps 20 allow the bracket 11 to pivot about frame 19 to adjust its position to conform to the position of the flexible sheeting 1 when inflated. Included on bracket 11 is an electrical inlet box 22 containing means for connecting to a source of electrical current, and an electrical outlet box 23 containing means for connecting an extension cord to power additional enclosures or other accessories. The S shaped flexible duct 13 is connected, as in FIG. 1, to the filter housing 14 and fitting 12 by hose clamps 24 and is retained in an upright position by strap 25 attached to the sheeting material. The relatively high position of the filter housing 14 with its open end with screen 16 (FIG. 6) facing in a downward direction prevents entry of water and snow into the enclosure.

As in FIG. 1, the perimeter of the enclosure is retained firmly on the ground by the weight of the vehicle 2 bearing on the support members 18 and supporting frame 19. Since the enclosure is self-supporting, it is completely free of the vehicle 2 at all points and under normal operating conditions cannot scratch or otherwise injure the finish of the vehicle. Further, since the enclosure assumes a semi-rigid airfoil-like shape, it is stable under windy outdoor conditions. The supporting frame 19 consists of several sections of circular steel tubing rigidly held together by screw-lock type connectors 20 which allow the frame to be quickly disassembled and stored or transported. As in FIG. 4, the frame sections at each end of the enclosure pass through pockets 21 formed by an additional thickness of the sheeting material. This locates the frame 19 precisely in the enclosure. The wheels 26 (FIG. 5) of the vehicle 2 rest upon support members 18 incorporating tabs 27 which engage frame 19 and hold frame 19 firmly against the inflation pressure which tends to lift the frame from the ground. As in FIG. 1, support members 18 can be adjustably positioned fore and aft along frame 19 corresponding to the wheelbase and length of the vehicle. As in FIG. 5, the front support members 18 contain a raised section 28 which functions as a stop when the vehicle is driven onto the enclosure.

Figure 4:
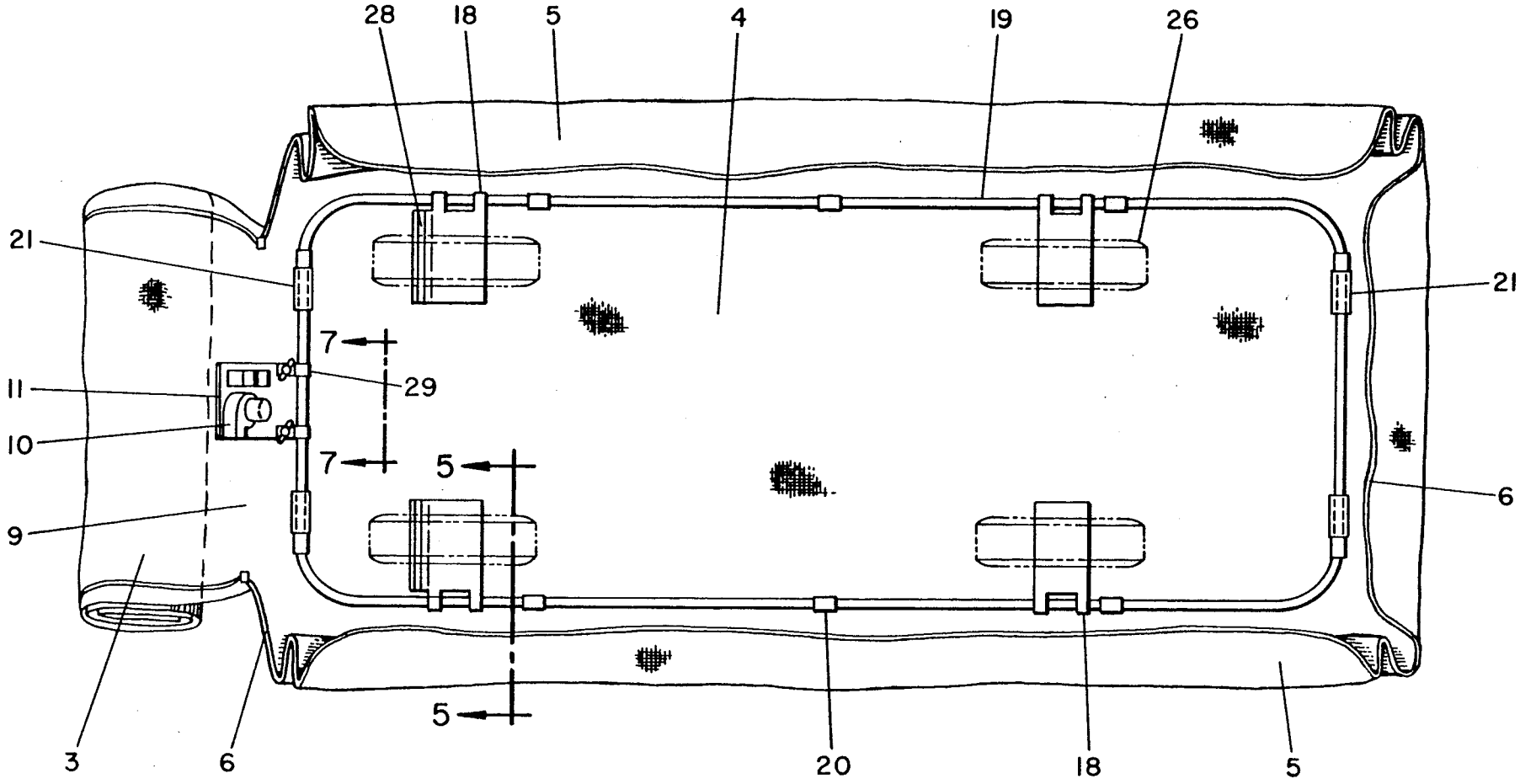
FIG. 4 is a top view of the enclosure prior to inflation with the slide fasteners open and the top portion of the flexible sheeting rolled up.
Figure 5:
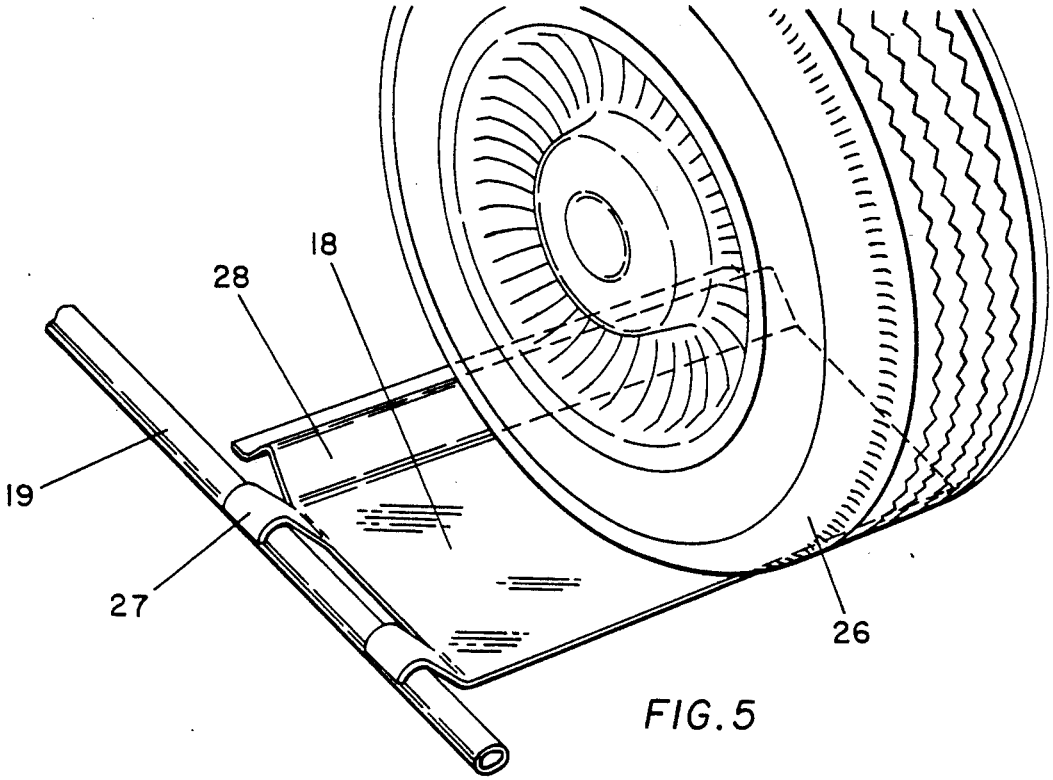
FIG. 5 is a close-up view of the front wheel of a vehicle resting upon a support member which engages the supporting frame of the enclosure.

To place a vehicle into the enclosure the sheeting material is spread out and positioned as shown in FIG. 4 with the sides 5 laying folded on each side and the top portion 3 rolled up at the forward end. The frame 19 is placed on the bottom sheeting 4 and connected using connectors 20. The support members 18 are then positioned according to the size of the vehicle 2 and the vehicle 2 is driven onto the enclosure with the front of the vehicle 2 toward fan 10 until the front wheels contact stop 28. The top portion 3 of the enclosure is rolled over the vehicle 2 and the slide fasteners 6 closed.

The fan motor 15 is then energized causing the enclosure to inflate to its operating configuration.

What is claimed is:

1. A portable protective enclosure for a vehicle comprising:

flexible sheeting means for totally surrounding a vehicle;

said sheeting means comprising a lower part and an upper part;

openable closure means for separating at least a part of the upper part from the lower part to allow the vehicle to be driven over the lower part, and for joining the lower part to the upper part to totally enclose the vehicle on all sides and on top and bottom;

frame means, locateable on the lower part, for retaining at least a part of the lower part on a ground surface against lifting air pressure;

support means for bearing the vehicle's weight beneath the vehicle, and for transmitting the weight outwardly to the frame means to hold said frame means down, and fan means, located within the enclosure, for pressurizing the enclosure and pneumatically supporting the flexible sheeting means spaced from upper surface of the vehicle.

2. A portable protective enclosure for a vehicle as claimed in claim 1, wherein said enclosure can be quickly disassembled and folded to be easily transportable.

3. A portable protective enclosure for a vehicle as claimed in claim 1, wherein said flexible sheeting is completely waterproof.

4. A portable protective enclosure for a vehicle comprising:

a flexible sheeting means for totally surrounding a vehicle; said flexible sheeting means comprising a lower part and an upper part;

an openable closure means for separating at least a part of said upper part from said lower part to allow the vehicle to be driven over said lower part, and for joining said lower part to said upper part to totally enclose the vehicle on all sides and on top and bottom;

an electric fan means for exchanging the air volume within the enclosure and for creating a positive air pressure within said enclosure to render the top portion of said enclosure pneumatically supported;

a frame means, locateable on said lower part, for retaining at least a part of said lower part on a ground surface against lifting air pressure; and support means for bearing the vehicles weight beneath the vehicle, and for transmitting the weight outwardly to said frame means to hold said frame means down.

5. A portable protective enclosure for a vehicle as claimed in claim 4, further comprising a filter means associated with said fan means to exclude foreign matter from said enclosure interior.

6. A portable protective enclosure for a vehicle as claimed in claim 5, wherein said filter means is contained in a filter housing, said filter housing being a closed chamber excepting its upper and lower ends; said upper end having a fitting to connect an air duct means and said lower end having provision for mounting a screen to exclude large particulate matter.

7. A portable protective enclosure for a vehicle as claimed in claim 6, wherein said upper end of said filter housing connects to an S shaped air duct leading to said electric fan within the enclosure.

8. A portable protective enclosure for a vehicle as claimed in claim 4, wherein said openable closure means is protected from water entry by an overlapping strip of said flexible sheeting.

9. A portable protective enclosure for a vehicle as claimed in claim 4, wherein said frame means comprises multiple pieces rigidly assembleable end to end by connector means, said connector means allowing quick assembly and disassembly.

10. A portable protective enclosure for a vehicle as claimed in claim 4, wherein said support means are freely resting on said supporting frame and are adjustably positionable to reside beneath each wheel of said vehicle.

11. A portable protective enclosure for a vehicle as claimed in claim 6, further comprising an air duct means, one end of said air duct means connecting to said upper end of said filter housing, the other end of said air duct means connecting to said electric fan means.

12. A portable protective enclosure for a vehicle as claimed in claim 4, wherein said flexible sheeting includes at least a singular pocket, said frame means passing through said pocket for locating said frame means on said lower part of the enclosure.

13. A portable protective enclosure for a vehicle as claimed in claim 4, wherein said openable closure means when closed provides for flow of air from the interior of the enclosure to the exterior for the purpose of ventilating said interior.

14. A portable protective enclosure for a vehicle, comprising;

a flexible sheeting means for totally surrounding said vehicle within the enclosure's interior;

a closure means attached in a generally horizontal circumferential direction to at least three sides of said enclosure for gaining access to said interior of said enclosure;

a supporting frame located on or near the bottom surface in said interior of said enclosure horizontally encircling said vehicle;

a plurality of support means for bearing upon said supporting frame at one end and for extending beneath said vehicle at the other end for allowing the weight of said vehicle to rest upon said support means thus fixedly holding the supporting frame in place; and means for easily moving and removing said support means relative to the frame means when said support means are unloaded but for positively locating said support means relative to said frame means when said support means are loaded.

15. A portable portective enclosure for a vehicle comprising;

flexible waterproof sheeting means for totally surrounding a vehicle;

said sheeting means comprising a lower part and an upper part;

openable closure means:

for separating at least a part of the upper part from the lower part to allow the vehicle to be driven over the lower part, and for joining the lower part to the upper part to totally enclose the vehicle on all sides and on top and bottom;

frame means, locatable on the lower part, for retaining at least part of the lower part on a ground surface against lifting air pressure; and support means:

for bearing the vehicle's weight beneath the vehicle, and for transmitting the weight outwardly to the frame means to hold said frame means down;

electric fan means locatable inside the enclosure for exchanging the air volume within the enclosure and for creating a positive air pressure within said enclosure to render the top portion of said enclosure pneumatically supported;

a filter means associated with said fan means to exclude foreign matter from said enclosure interior;

said filter means being contained in a filter housing, said filter housing being a closed chamber excepting its upper and lower ends; said upper end having a fitting to connect an air duct means and said lower end having provision for mounting a screen to exclude large particulate matter;

said upper end of said filter housing connecting to an S shaped air duct leading to said electric fan within the enclosure;

said openable closure means being protected from water entry by an overlapping strip of said flexible sheeting;

said frame means comprising multiple pieces rigidly assembleable end to end by connector means, said connector means allowing quick assembly and disassembly; and said support means are freely resting on said supporting frame and are adjustably positionable to reside beneath each wheel of said vehicle.

16. A portable protective enclosure for a vehicle comprising:

a flexible sheeting means formed into a continuous closed chamber surrounding the vehicle on all sides and on top and bottom;

an openable closure means for providing an openable seam in at least a part of said flexible sheeting means to allow the vehicle to be driven into said portable protective enclosure;

an electric fan means, locateable inside the enclosure, for creating a positive air pressure within the enclosure to render said enclosure pneumatically supported, and for exchanging the air volume within said enclosure thereby maintaining an air temperature within said enclosure nearly equal to the air temperature outside said enclosure.

17. A portable protective enclosure for a vehicle as claimed in claim 16, further comprising a frame means positionable within said portable protective enclosure for retaining at least a part of said flexible sheeting means on a ground surface against lifting air pressure.

18. A portable protective enclosure for a vehicle as claimed in claim 17, wherein said frame means comprises a plurality of sections assembleable end to end by connector means, said connector means allowing rapid assembly and disassembly.

19. A portable protective enclosure for a vehicle as claimed in claim 17, further comprising support means bearing upon said frame means and extending beneath the vehicle thereby transferring the weight of the vehicle to said frame means to hold said frame means down.

20. A portable protective enclosure for a vehicle as claimed in claim 19, wherein said support means are adjustably positionable to reside beneath each wheel of the vehicle.

21. A portable protective enclosure for a vehicle as claimed in claim 16, further comprising a filter means interposed with the air stream to said fan means to clean the air entering the enclosure.

22. A portable protective enclosure for a vehicle as claimed in claim 16, wherein said flexible sheeting means includes a portion of the flexible sheeting positioned to overlap said openable closure means thereby protective the closure means from water entry.

23. A portable protective enclosure for a vehicle as claimed in claim 17, wherein said flexible sheeting includes at least a singular pocket, said frame means passing through said pocket for locating said frame means relative to the enclosure.

24. A portable protective enclosure for a vehicle as claimed in claim 16, wherein said openable closure means when closed provides for flow of air from the interior of the enclosure to the exterior for the purpose of ventilating said interior.

* * * * *